US005816947A

United States Patent [19]

Kavitch

[11] Patent Number: 5,816,947

[45] Date of Patent: Oct. 6, 1998

[54] GOAL LIGHT AND SIREN WITH SENSORS FOR A HOCKEY NET

[76] Inventor: Daniel Kavitch, 10608 Fernglen Ave., Tujunga, Calif. 91042

[21] Appl. No.: 932,814

[22] Filed: Sep. 16, 1997

[51] Int. Cl.[6] ..... A63B 63/00

[52] U.S. Cl. ..... 473/478; 273/374

[58] Field of Search ..... 473/478, 479, 473/480, 471, 472; 273/371, 374, 375, 376, 378, 381, 383, 400

[56] References Cited

U.S. PATENT DOCUMENTS

| | | | |
|---|---|---|---|
| 1,995,872 | 3/1935 | Ukanavage | 473/480 |
| 3,367,661 | 2/1968 | Dean, Jr. . | |
| 3,706,451 | 12/1972 | Dixon | 273/383 |
| 4,691,920 | 9/1987 | Murphy et al. . | |
| 5,064,195 | 11/1991 | McMahan et al. . | |
| 5,326,094 | 7/1994 | Quinn . | |
| 5,509,650 | 4/1996 | MacDonald . | |
| 5,615,880 | 4/1997 | Booth et al. | 473/471 |
| 5,685,789 | 11/1997 | Murphy | 473/478 |

*Primary Examiner*—William H. Grieb
*Attorney, Agent, or Firm*—James E. Brunton

[57] ABSTRACT

A signaling apparatus which can be readily attached to any hockey goal proximate the hockey net in a manner so as to positively indicate by means of the energization of a light siren when a playing piece passes through the goal opening and impacts the net. The apparatus is useable either with an ice hockey goal or alternatively, is useable with a goal of the character found in the game of street hockey, or in a smaller form for indoor use.

20 Claims, 5 Drawing Sheets

FIG. 1
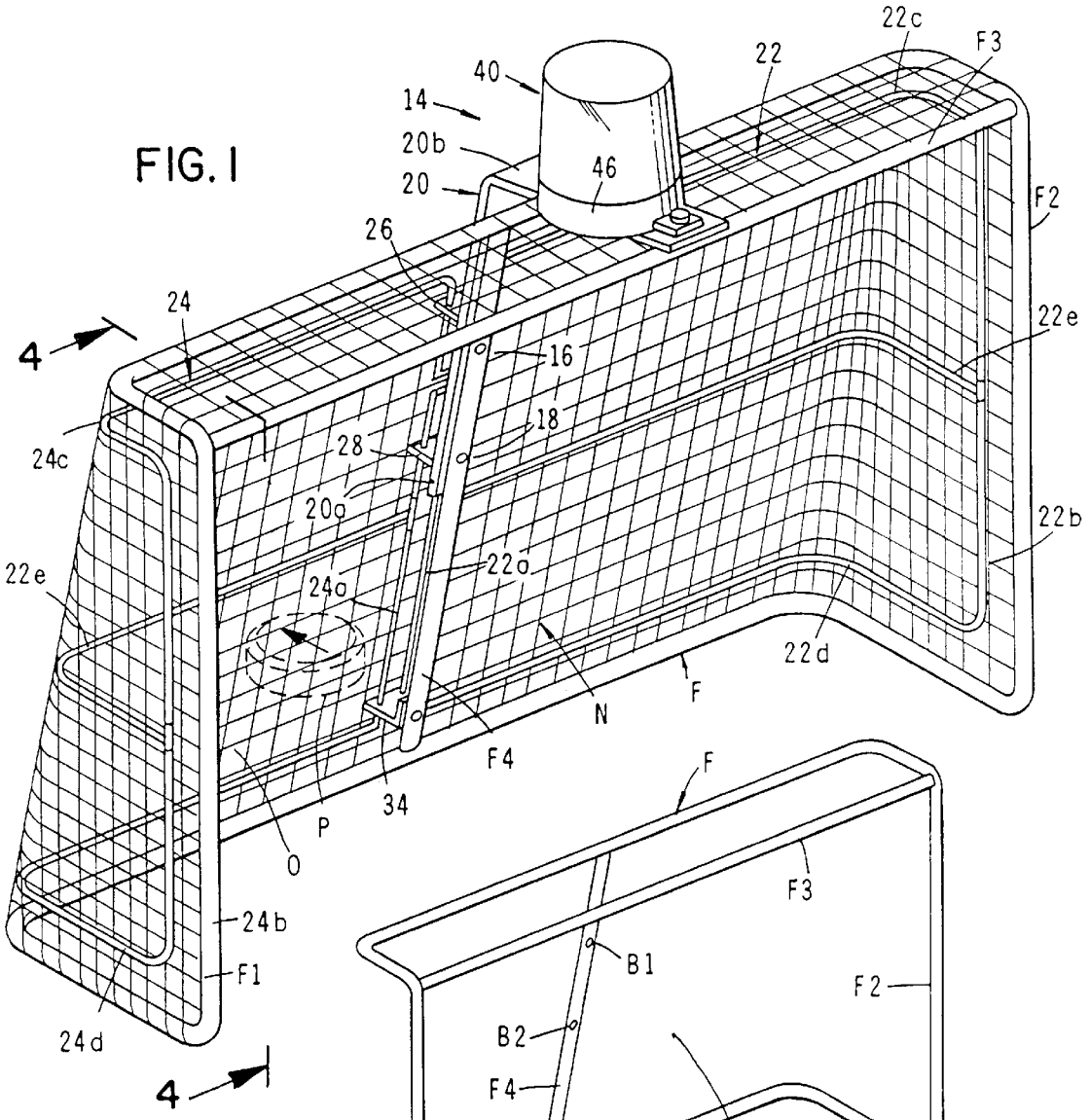
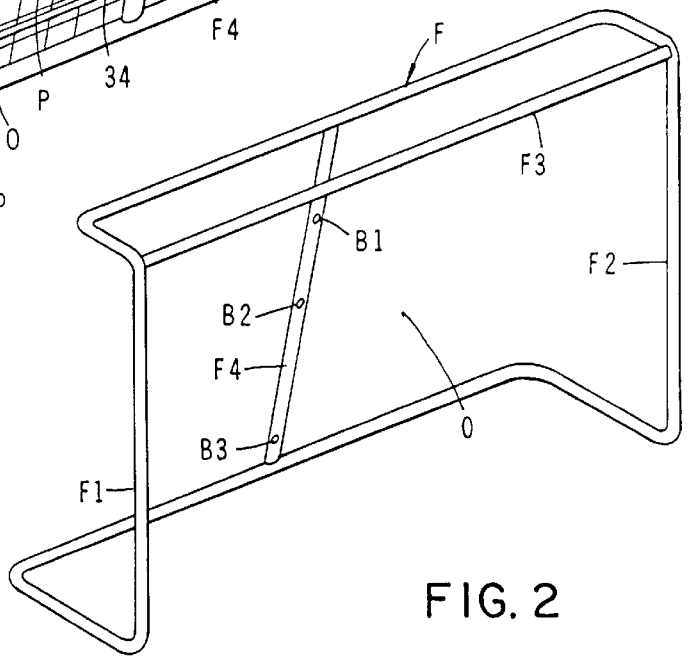
FIG. 2

FIG. 6
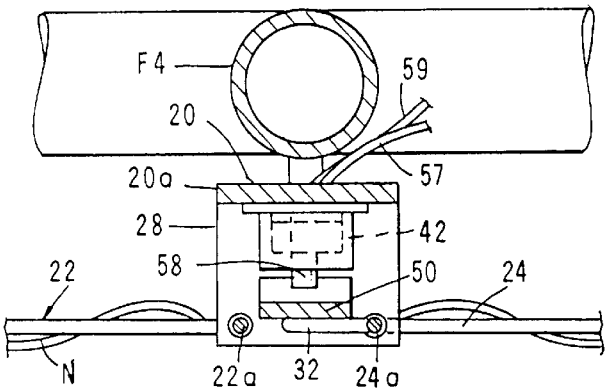
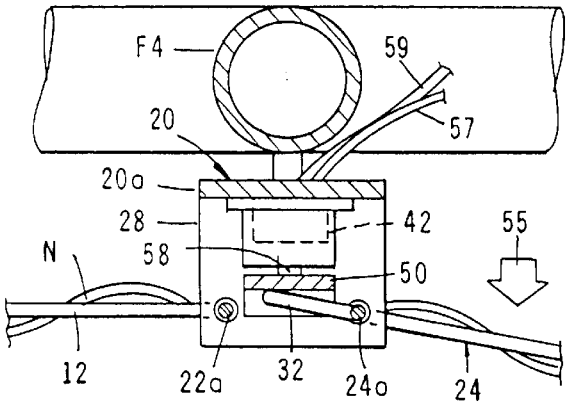
FIG. 8
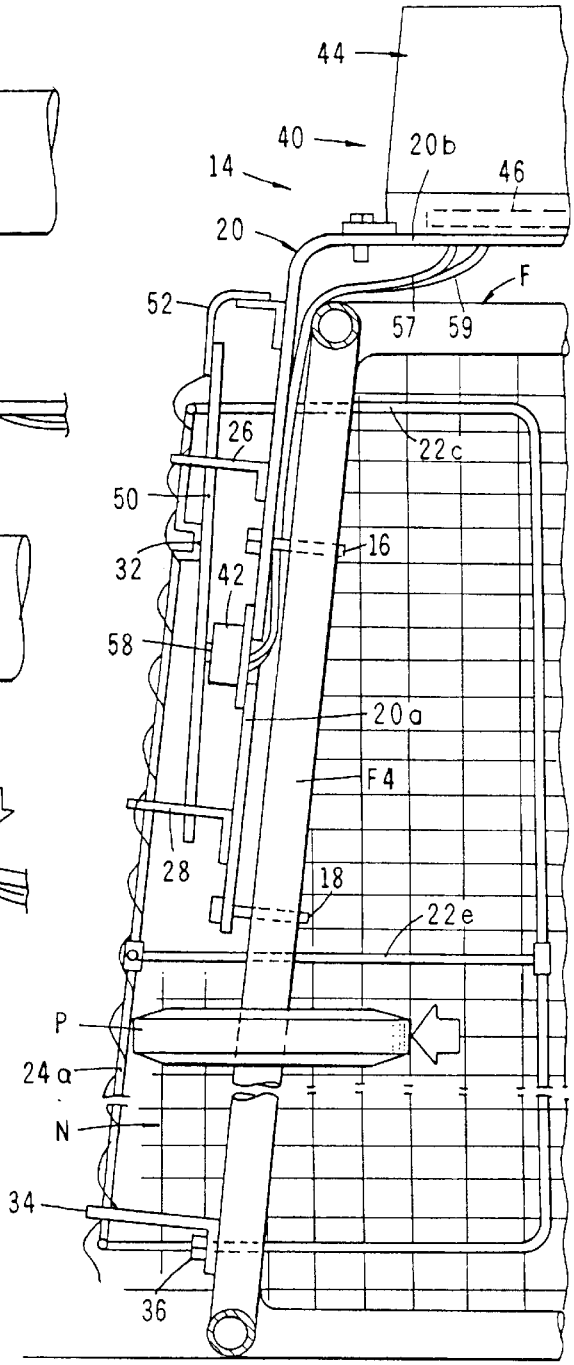
FIG. 7

GOAL LIGHT AND SIREN WITH SENSORS FOR A HOCKEY NET

BACKGROUND OF THE INVENTION

1. Field of the Invention

The present invention relates generally to an attachment to a goal such as a hockey goal. More particularly, the invention concerns a goal signaling apparatus for use in connection with sports which involve propelling a playing piece into a goal of the character having a flexible net which is impacted by the playing piece upon a goal being scored.

2. Discussion of the Prior Art

A number of popular sports involve the use of a playing piece such as a hockey puck, a ball or other object, wherein the object of the sport is to propel the playing piece through a goal having a flexible net which is impacted by the playing piece upon a goal being scored. One such sport which has become extremely popular in recent years is the sport of hockey. The traditional hockey game is played on ice with a playing piece called a puck which consists of a small disk-like object which is propelled at high speeds toward hockey goals provided at each end of the hockey rink. The hockey goal typically comprises a frame having a front facing opening which defines the target area for the puck. A flexible net is supported by the frame in such a manner that it will be impacted by the puck upon the puck passing through the front facing target opening.

A variation of the traditional hockey game, is a game called street hockey. The playing pieces in street hockey are either a ball or a specially designed (low surface resistance) hockey puck. The game is typically played out of doors. The street hockey goal is similar in configuration to the ice hockey goal and also includes a frame having a goal defining front opening which supports a flexible net that is impacted by the ball or puck upon the ball or puck passing through the opening in the net.

In the past, a number of different types of devices have been suggested for use in connection with goals, such as hockey goals. One such a device, which is directed toward improving the player's skill, is disclosed in U.S. Pat. No. 5,509,650 issued to MacDonald. The MacDonald apparatus comprises a target support which is the approximate size of a hockey goal and includes at least two targets positioned on the support. The targets are representative of areas which are typically unprotected by a hockey goal keeper in a common goal guarding position. A sensor representing a player in a predetermined location proximate of the target support generates a signal to a processor which executes a program to indicate at least one of the targets on the support as a current target for which the player should aim. The current target indicator is activated for a predetermined period of time, or until the playing piece successfully strikes the current target.

Another type of target scoring device is disclosed in U.S. Pat. No. 3,706,451 issued to Dixon. This device includes a target formed of resilient material having a plate positioned in a spaced relationship behind the target and having indicia thereon to define a scoring area on the target. A rotatable member is carried by the plate and includes markings to indicate a score as a result of the scoring area of the target being struck by an object.

A somewhat similar target type scoring device to that suggested by Dixon is disclosed in U.S. Pat. No. 3,367,661 issued to Dean Jr.. The Dean Jr. apparatus comprises a flexible, planar target member and a target holding means having a bottom which is electrically conductive. The target holding means is provided with wall portions which support the target member in a spaced parallel relation with respect to the bottom of the target holding means. The target member includes a layer of electrically conducting material which is adapted to make momentary contact with the bottom of the target holding means when a hit is received by the target so as to complete an electrical circuit connected between the target member and the target holding means.

U.S. Pat. No. 5,615,880 issued to Booth et. al., discloses an electronic goal detecting system for detecting an object such as a hockey puck or hockey ball passing through the goal posts of a hockey goal. The device of the invention includes a hockey goal and a sensing means mounted on the hockey goal for sensing the passage through the goal of a game piece such as a hockey puck or hockey ball. A power supply is electronically connected to the sensing means and to a goal signal means which is electronically connected to the sensing means. A speaker is secured to the front support member of the apparatus and is electronically connected to the sensing means to provide an audio signal upon passage through the goal of the game piece.

A somewhat similar audio sports game is disclosed in U.S. Pat. No. 5,326,094 issued to Quinn. The Quinn apparatus comprises a sports game which uses an audio message generator that selectively generates one of a plurality of audio messages when the message generator is actuated by a switch. The message is generated prior to and during the user attempting to cause an object to pass through an opening in the structure such as a sports goal.

Unlike the apparatus disclosed in the prior art, the device of the present invention comprises a simple, easy to use apparatus that attaches directly to a hockey net and positively indicates by light and sound when a playing piece passes through the goal opening and impacts the hockey net. The apparatus of the invention can be used with a traditional (non-professional) type of ice hockey net or, alternatively, can be used with street hockey nets. These and other major differences between the apparatus of the present invention and those described in the prior art will become readily apparent from the discussion which follows.

SUMMARY OF THE INVENTION

It is a primary object of the present invention to provide a device which can be readily attached to any hockey goal proximate the hockey net in a manner so as to positively indicate by means of the energization of a light and a siren when a playing piece passes through the goal opening and impacts the net.

Another object of the invention is to provide a device of the aforementioned character which is of simple construction, is light weight, easy to install and extremely durable in use.

Another object of the invention is to provide an apparatus as described in the preceding paragraphs which is useable either with a conventional type of ice hockey goal or alternatively, is useable with a goal of the character found in the game of street hockey, or in its smaller form to include a net (approximately 24 inches in width and 16 inches in height by 11 inches in depth) for indoor use.

Another object of the invention is to provide a free-standing, self-contained goal signaling apparatus which includes a goal light, an audio signaling device and novel, electromechanical sensors for activating the goal light and audio signaling device upon the hockey net being impacted by a playing piece.

BRIEF DESCRIPTION OF THE DRAWINGS

FIG. 1 is a generally perspective view of the goal signaling apparatus of the present invention shown interconnected with a conventional street hockey goal.

FIG. 2 is a generally perspective view of the supporting frame of the ice hockey goal shown in FIG. 1.

FIG. 6 is an enlarged, cross-sectional view taken along lines 6—6 of FIG. 5.

FIG. 7 is a view similar to FIG. 4, but showing the hockey net being impacted by a hockey puck in a manner to impart pivotal movement to one of the sensor arms of the apparatus.

FIG. 8 is a cross-sectional view similar to FIG. 6, but showing the right hand actuator arm having been moved as a result of the hockey puck impacting the hockey net.

DESCRIPTION OF THE INVENTION

Figure 3:
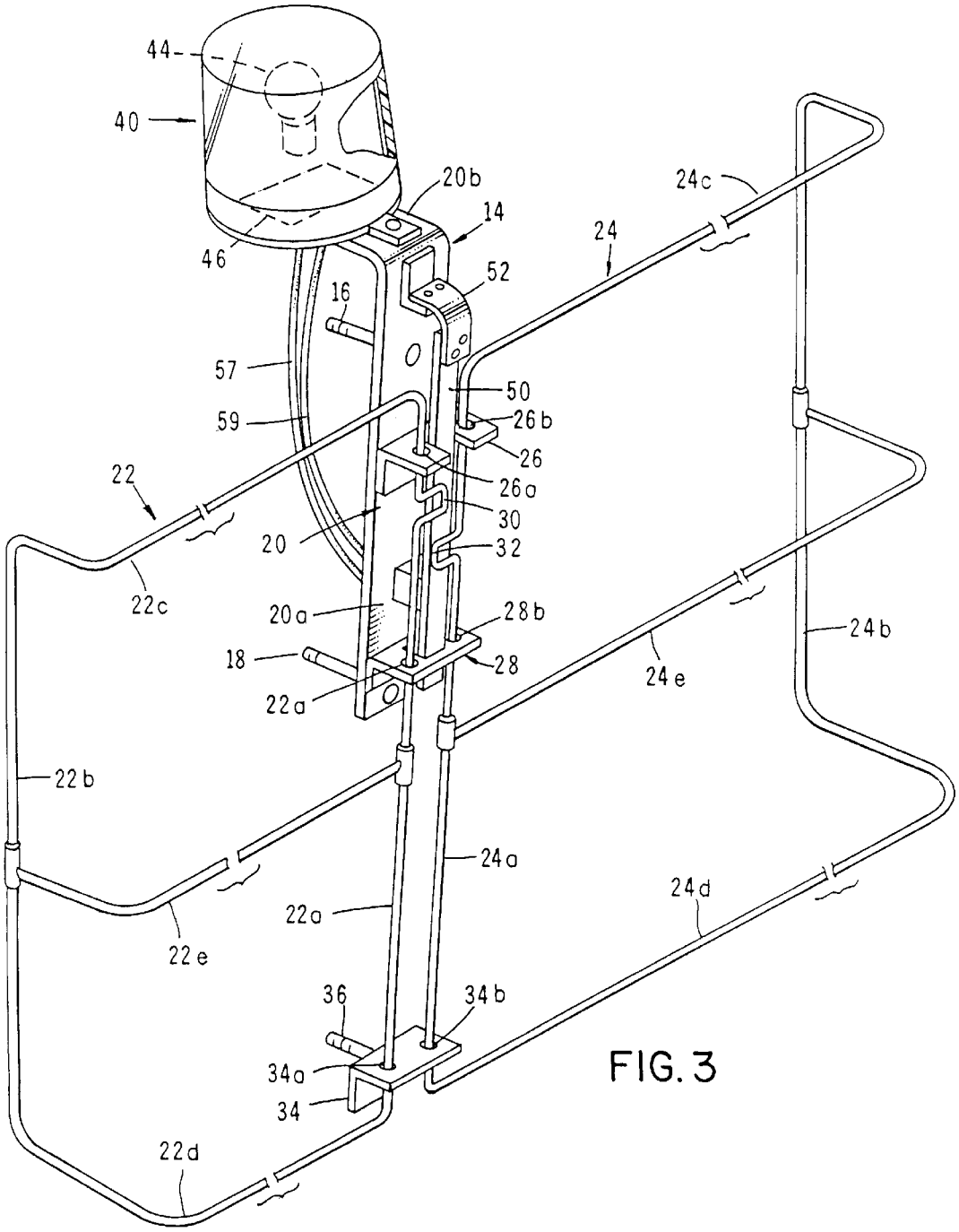
FIG. 3 is an enlarged, generally perspective view of one form of the goal signaling apparatus of the present invention shown separated from the hockey goal.
Figure 4:
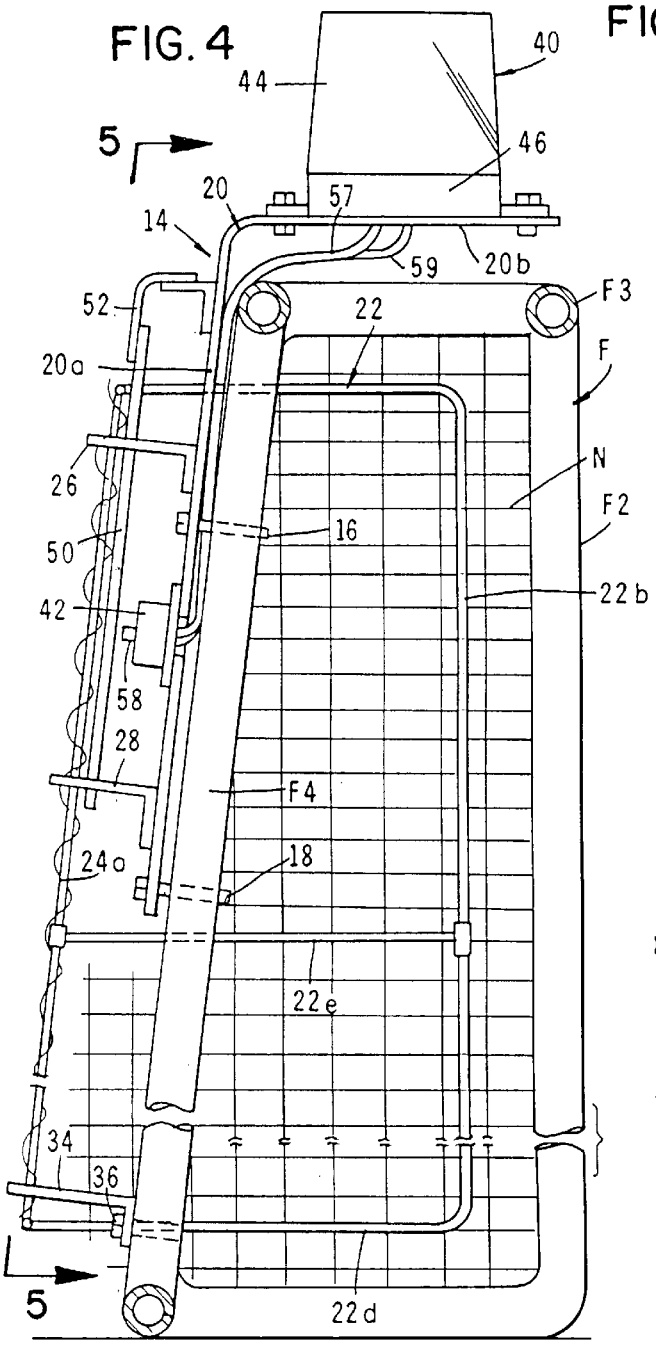
FIG. 4 is an enlarged view taken along lines 4—4 of FIG. 1.
Figure 5:
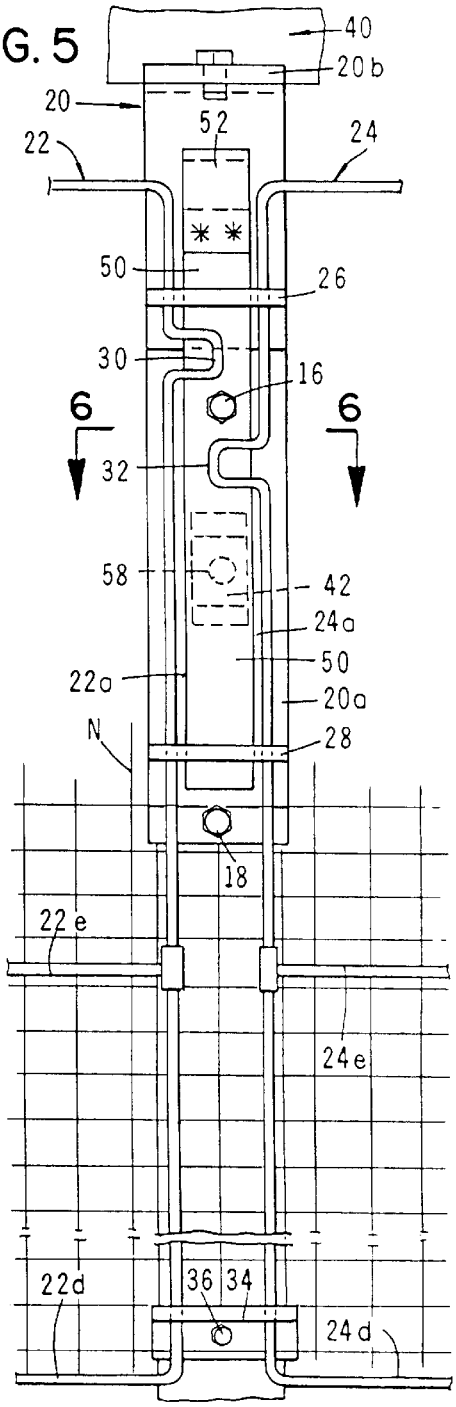
FIG. 5 is a view taken along lines 5—5 of FIG. 4.

Referring particularly to FIGS. 1, 2 and 3, one form of the signal producing apparatus of the present invention is there illustrated and generally designated by the numeral 14. As best seen in FIG. 3, the signal producing apparatus of the invention is adapted for use with a game target of the character having a net supporting frame "F" (FIG. 2), defining a target opening "O" and a flexible net "N" (FIG. 1) supported by the net supporting frame "F" in a position to be impacted by a game piece such as a hockey puck "P" passing through the target opening "O". Net supporting frame "F" is of a configuration generally found in conventional hockey net assemblies and includes side members F1 and F2 which along with a transversely extending upper frame member F3 define the target opening "O". The net "N" is affixed to frame "F" by any suitable means and, in the manner shown in FIG. 1, drapes over the back and side portions of the frame "F". A ridged central support column F4 supports the central portion of the net "N" in the manner shown in FIG. 1.

The signal producing apparatus of the invention, the construction of which is best seen in FIG. 3, is interconnectable with the net supporting frame "F" by means of connector means provided here as a pair of threaded connectors 16 and 18 which extend through drilled bores B1 and B2, formed in central support column F4 of frame "F". Threaded connectors 16 and 18 extend outwardly from a central support member 20, which here comprises an angle member having a generally vertically extending leg 20*a* and a generally horizontally extending leg 20*b*. (FIG. 3). With the signal producing apparatus 14 interconnected with Frame "F" in the manner shown in FIG. 1, a pair of side frames 22 and 24 engage the back of the net end and substantially circumscribe the side portions of the net.

First and second actuating frames 22 and 24 are pivotably supported by upper and lower support brackets 26 and 28 which are, in turn, connected to central support 20 in the manner best seen in FIG. 3. Actuating frame 22 comprises a first end rod 22*a* which is disposed in a first plane and second end rod 22*b* which is disposed in a second plane that is spaced apart from the plane within which side rod 22*a* resides. Curved top and bottom rods, 22*c* and 22*d* interconnect side rods 22*a* and 22*b* in the manner best seen in FIG. 3. Also forming a part of actuating frame 22 of the invention is a centrally disposed, curved frame member 22*e* which interconnects side rods 22*a* and 22*b* proximate their mid points. As best seen in FIG. 3, rod 22*a* extends through apertures 26*a* and 28*a* formed in brackets 26 and 28 respectively. For a purpose presently to be described, side rod 22*a* includes a generally "U" shaped finger like protrusion 30.

Actuating frame 24 is of similar construction to frame 22 and includes a first end rod, 24*a* disposed in the first plane and a second end rod 24*b* disposed in a second plane spaced apart from the plane within which rod 24*a* resides. Top and bottom rods 24*c* and 24*d* interconnect side rods 24*a* and 24*b* in the manner shown FIG. 3. A curved, centrally disposed support rod 24*e* interconnects rods 24*a* and 24*b* proximate their mid points. End rod 24*a* of frame 24 extends through apertures 26*b* and 28*b* formed in brackets 26 and 28, respectively. Like end rod 20*a*, end rod 24*a* also includes a generally "U" shaped finger 32, the purpose to which will presently be described.

In the form of the invention shown in the drawings, a third connector bracket 34, which is provided with apertures 34*a* and 34*b*, also pivotably supports actuating frames 22 and 24. Bracket 34 is provided with a threaded connector member 36 which extends through a drilled bore B3 provide in central support member F4 of frame "F". Threaded member 36 functions to interconnect bracket 34 with central support member f4 in the manner best seen in FIG. 1.

With the construction described in the preceding paragraphs, when the game piece or game projectile such as hockey puck "P" impacts the net of the game target, one or the other of the actuating frames 22 or 24 will be urged by the net to pivot about brackets 26, 28 and 34. More particularly, if the game piece impacts the right hand portion of the net "N" as viewed in FIG. 1, the net will move rearwardly causing actuating frame 24 to pivot about the supporting brackets. Similarly, if the target piece such as the puck "P" shown in FIG. 1, impacts the left hand portion of the net "N", the deforming net will cause pivotal movement of actuating frame 22 relative to the supporting brackets.

Forming an important aspect of the apparatus of the present invention is signaling means which is here connected to support 20 and functions to produce a signal upon pivotable movement by one of the first and second actuating frames 22 and 24. In the form of the invention shown in the drawings, the signaling means comprises a signal apparatus 40 which is mounted on horizontal leg 20*b* of support 20 and a switch means which is operably associated with signal 40. In a manner next to be described the switch means functions to activate the signal upon the switch means being closed by one of the actuating frames moving in response to movement of the goal net "N". The switch means here comprises a switch mechanism 42 which is mounted on the generally vertically extending leg 20*a* of support 20. While the signaling means can take various forms, it is here provided as a conventional light emitting element, such as a rotary warning light 44 and a conventional sounding element 46, such as a siren.

Figure 9:
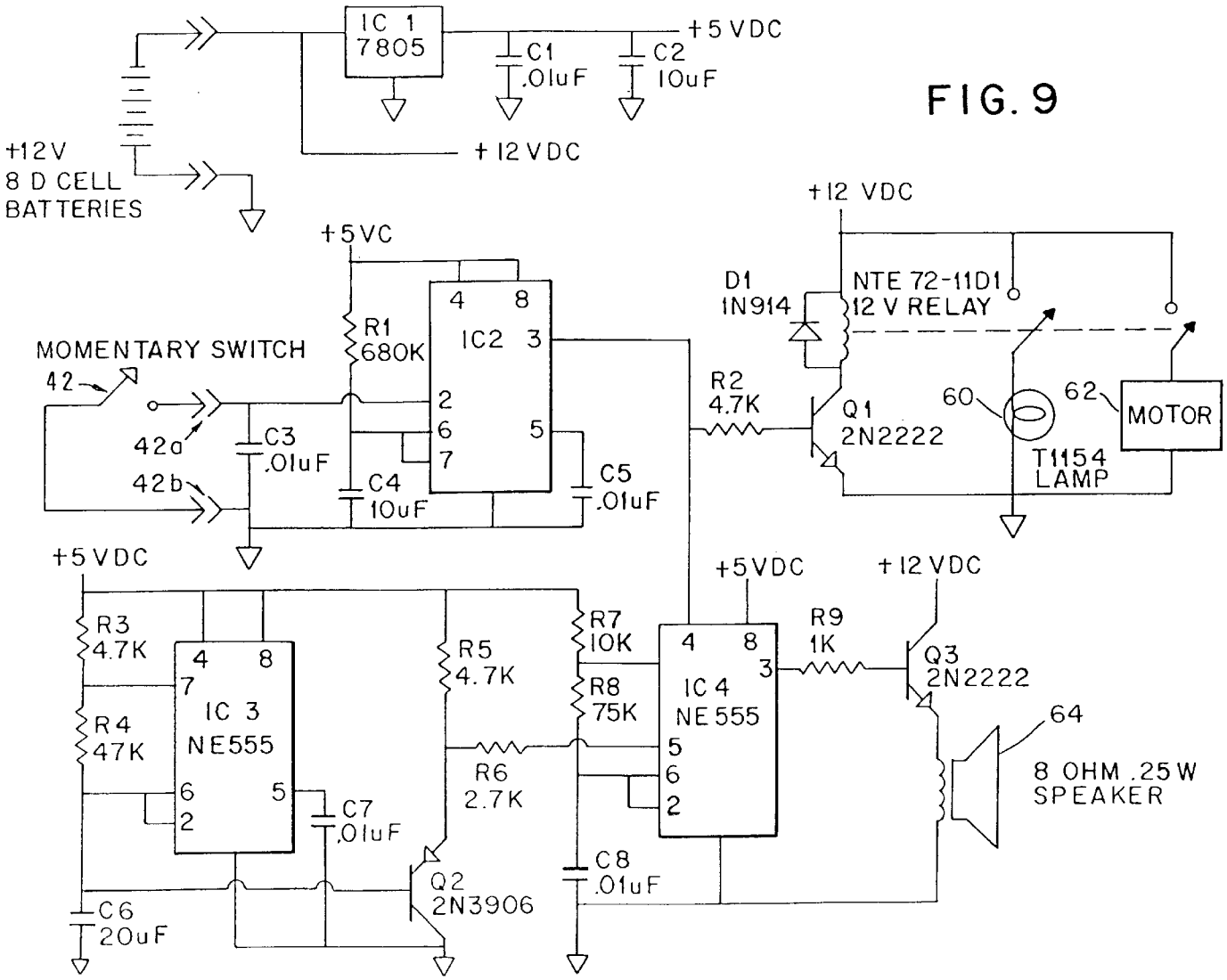
FIG. 9 is a generally schematic view of the electric circuitry of the apparatus of the invention.

Also forming a part of the important switch means of the invention, is an exciter bar 50 which is connected to vertically extending leg 20*a* of central support 20 by biasing means shown here as a yieldably, deformable flat spring member 52. With this construction, exciter bar 50 is movable relative to central support 20 and switch mechanism 22 which is mounted thereon between a first, relaxed position and a second, switch actuating position in response to pivotable movement of the actuating frames 22 and 24. More particularly, when the apparatus is in a static, at rest state, exciter bar 50 and frames 22 and 24 are in the position shown in FIG. 6. In this position, actuating fingers 30 and 32 of frames 22 and 24 respectively rest against exciter bar 50 which is being biased outwardly toward the actuating fingers by means of biasing spring 52. However, upon the game projectile, in this case, puck "P", impacting the net "N" in the manner shown in FIG. 7, the net will engage actuating frame 24 moving it in the direction of the arrow 55 of FIG. 8. Movement of the actuating frame in this direction will cause finger 32 to impinge upon exciter bar 50 in the manner shown in FIG. 8 causing it to move inwardly toward switch mechanism 42. As the exciter bar engages switch mechanism 42, it will impart an inward force on a plunger element 58 which comprises a part of switch mechanism 42, causing the plunger element to move telescopically inward from the position shown in FIG. 6 to the position shown in FIG. 8. As indicated in FIG. 9, switch mechanism 42, which comprises a conventional, normally open, momentary switch, includes first and second contacts 42*a* and 42*b* respectively. Inward movement of plunger 58 of the switch mechanism will cause contact 42*a* to move from the open position shown in FIG. 9 into the switch closed position wherein contact 42 is in engagement with contact 42*b*. Switch mechanism 42, which is of a standard construction well known to those skilled in the art and is readily commercially available from sources such as Dow Radio of Pasadena Calif., is suitably interconnected with signal 40 by a pair of electrical connectors 57 and 59.

In the operation of the apparatus of the invention, when the game piece or projectile such as the puck "P" impacts the right hand portion of the net "N", actuating frame 24 will be pivoted in a manner such that finger 32 will cause exciter bar 50 to move against the resistance of biasing spring 52 in a direction toward the plunger 58 of switch mechanism 42. Movement of the switch plunger will close the switch contact so as to energize the signal means in a manner presently to be described. In a similar fashion, if the puck or game piece strikes the left hand side of the net as shown in FIG. 1, actuating frame 22 will be moved pivotably rearwardly by the net, causing finger 30 to engage exciter bar 50 and move it inwardly in a direction toward plunger 58 as a result of forces imparted to the net by the projectile striking the net. Once again, movement of the exciter bar toward plunger 58 of the switch mechanism will cause the switch contacts to momentarily close so as to energize the signaling means of the invention.

Referring next to FIG. 9, one form of the working circuitry of the apparatus of the invention is there schematically shown. This circuit is of a conventional design well understood by those skilled in the art. The upper portion of FIG. 9 represents the circuitry for operating the light emitting element which is here shown as a six volt lamp, 60. In the form of the invention shown in the drawings, lamp 60 forms a part of a conventional, commercially available rotary warning light assembly which also includes a small motor 62. Motor 62, when energized, rotates a base to which lamp 60 is interconnected.

Also forming a part of the signaling means of the invention is a sound emitting element, the operating circuit for which is shown in the lower portion of FIG. 9. In this form of the invention, the sound emitting element comprises a speaker assembly 64, which here takes the form of a siren. The entire light emitting assembly 44 of the apparatus of the present invention is of a character well known to those skilled in the art and is commercially available from a number of sources including Arrow Safety Device Co. Similarly, the sound emitting assembly 46 is of a character that is readily commercially available from a number of sources including Fun Rise Toy Company of Woodland Hills, Calif.

As indicated by the circuit diagram in FIG. 9, the six volt lamp 60, the motor 62, and the speaker 64, are all powered by direct current sources such as the 8 D cell batteries identified in FIG. 9. The batteries are operably associated with momentary switch 42 so that upon closing the switch, lamp 60, motor 62 and sound emitter or siren 64 will all simultaneously be energized.

By way of summary, the circuitry of the invention as shown in FIG. 9, operates in the following manner. Closing the momentary switch 42 energizes lamp 60, motor 62, and siren 64 for approximately 6 seconds. The switch then resets itself, de-energizing those components until the switch is once again closed. More specifically, closing the switch 42 also triggers the NE555 Timer IC2 which is configured as a one-shot timer. Pin 3 of IC2 goes high closing the relay NTE 72. When relay NTE 72 closes, it energizes motor 62 and lamp 60. Pin 3 of Timer IC2 stays high approximately 6 seconds until the voltage on the capacitor of C4 charging through the resistor R1 reaches the trigger voltage of pin 6 resetting Timer IC2. When Timer IC2 resets, pin 3 goes low and turns off the relay until it is triggered again by switch 42. The other two NE555 ICs, namely IC3 and IC4, control siren 64. These ICs are both configured as oscillators. More particularly, IC3 is a low frequency oscillator which modifies the frequency of audio oscillator IC4. As shown in FIG. 9, the output of IC4 is amplified by transistor Q3 and heard through speaker 64. IC4 is disabled through pin 4 until pin 3 of the Timer IC2 does high. It is to be understood that variations of the circuit shown in FIG. 9 could be made to accommodate other types of visual and audio signaling devices which might be used in connection with the sensor means of the apparatus.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made with out departing from the scope and spirit of the invention, as set forth in the following claims.

I claim:

1. A signal producing apparatus for use with a game target of the character having a net supporting frame defining a target opening and a flexible net supported by the net supporting frame in a position to be impacted by a game piece passing through the target opening, said signal producing apparatus comprising:

(a) a support interconnectable with the net supporting frame;

(b) sensor means connected to said support proximate the net for sensing movement of the net caused by the net being impacted by the playing piece; and (c) signaling means connected to said support and associated with said sensor means for producing a signal upon said sensor means sensing movement of the net, said signaling means comprising:

(i) a signal mounted on said support; and (ii) switch means operably associated with said sensor means and with said signal for activating said signal upon said sensor means sensing movement of the net.

2. An apparatus as defined in claim 1 in which said signal comprises light.

3. An apparatus as defined in claim 1 in which said signal comprises a sound.

4. An apparatus as defined in claim 1 in which said sensor means comprises first and second actuating elements pivotally connected to said support.

5. An apparatus as defined in claim 4 in which each of said first and second actuating elements comprises a frame having:

(a) a first end rod disposed in a first plane;

(b) a second end rod disposed in a second plane spaced apart from said first plane; and (c) top and bottom rods interconnecting said first and second end rods.

6. An apparatus as defined in claim 5 in which said support comprises:

(a) an angle member having a generally vertically extending leg and a generally horizontally extending leg;

(b) connector brackets connected to said generally vertically extending leg for pivotally interconnecting said first end rods of said first and second actuating elements with said generally vertically extending leg of said support; and (c) at least one outwardly extending connector member for connecting said support to the net support frame of the game target.

7. An apparatus as defined in claim 6 in which said signaling means is connected to said generally horizontally extending leg of said support and comprises a light emitting signal.

8. An apparatus as defined in claim 6 in which said switch means comprises:

(a) an excitor bar connected to said generally vertically extending leg of said support for movement from a first position to a second position in response to pivotal movement of said actuating elements; and (b) a switch mechanism connected to said vertically extending leg, said switch mechanism including a plunger element movable from a first switch open to a second switch closed position upon movement of said excitor bar from said first position to said second position.

9. An apparatus as defined in claim 8 further including biasing means for yieldably biasing said excitor bar toward said first position.

10. An apparatus as defined in claim 9 in which each of said first and second actuating elements includes an excitor bar engaging finger for engagement with said excitor bar to move said excitor bar toward said second position.

11. A signal producing apparatus for use with a game target of the character having a net supporting frame defining a target opening and a flexible net supported by the net supporting frame in a position to be impacted by a game piece passing through the target opening, said signal producing apparatus comprising:

(a) a support interconnectable with the net supporting frame;

(b) first and second actuating frames pivotally connected to said support in proximity to the flexible net for movement by the flexible net upon the net being impacted by the playing piece; and (c) signaling means connected to said support for producing a signal upon movement by one of said first and second actuating frames, said signaling means comprising:

(i) a signal mounted on said support; and (ii) switch means operably associated with said signal for activating said signal upon operation of said switch means by one of said actuating frames.

12. An apparatus as defined in claim 11 in which each of said first and second actuating frames comprises:

(a) a first end rod disposed in a first plane;

(b) a second end rod disposed in a second plane spaced apart from said first plane; and (c) top and bottom rods interconnecting said first and second end rods.

13. An apparatus as defined in claim 12 in which said support comprises:

(a) an angle member having a generally vertically extending leg and a generally horizontally extending leg;

(b) connector brackets connected to said generally vertically extending leg for pivotally interconnecting said first end rods of said first and second actuating frames with said generally vertically extending leg of said support; and (c) means for connecting said support to the net support frame of the game target.

14. An apparatus as defined in claim 13 in which said signaling means comprises a light emitting element and a sound emitting element connected to said generally horizontally extending leg of said support.

15. An apparatus as defined in claim 13 in which said switch means comprises:

(a) an excitor bar connected to said generally vertically extending leg of said support for movement from a first position to a second position in response to pivotal movement of said actuating frames; and (b) a switch connected to said vertically extending leg, said switch having first and second contacts, said first contact being operably associated with said excitor bar for movement thereby from a first location spaced apart from said second contact to a second location in engagement with said second contact.

16. A signal producing apparatus for use with a game target of the character having a net supporting frame defining a target opening and a flexible net supported by the net supporting frame in a position to be impacted by a game piece passing through the target opening, said signal producing apparatus comprising:

(a) a support interconnectable with the net supporting frame, said support comprising:

(i) an angle member having a generally vertically extending leg and a generally horizontally extending leg;

(ii) connector brackets connected to said generally vertically extending leg; and (iii) a pair of outwardly extending, threaded connectors for connecting said support to the net support frame of the game target, (b) first and second actuating frames pivotally connected to said connector brackets of said support in proximity to the flexible net for movement by the flexible net upon the net being impacted by the playing piece, each said first and second actuating frames comprising:

(i) a first end rod disposed in the first plane;

(ii) a second end rod disposed in a second plane spaced apart from said first plane; and (iii) top and bottom rods interconnecting said first and second end rods; and (c) signaling means connected to said support for producing a signal upon movement by one of said first and second actuating frames, said signaling means comprising:

(i) a signal mounted on said support; and (ii) switch means operably associated with said signal for activating said signal upon operation of said switch means by one of said actuating frames.

17. An apparatus as defined in claim 16 in which said signaling means comprises a light emitting element connected to said generally horizontally extending leg of said support.

18. An apparatus as defined in claim 16 in which said signaling means comprises a sound emitting element connected to said generally horizontally extending leg of said support.

19. An apparatus as defined in claim 16 in which said signaling means comprises a light emitting element and a sound emitting element connected to said generally horizontally extending leg of said support.

20. An apparatus as defined in claim 16 in which said switch means comprises:

(a) an excitor bar connected to said generally vertically extending leg of said support for movement from a first position to a second position in response to pivotal movement of said actuating frames; and (b) a switch connected to said vertically extending leg, said switch having first and second contacts, said first contact being operably associated with said excitor bar for movement thereby from a first location spaced apart from said second contact to a second location in engagement with said second contact.

* * * * *